United States Patent [19]

Guidry

[11] 3,974,598

[45] Aug. 17, 1976

[54] BACKING DISC WITH MEANS TO EXPEL ABRADED PARTICLES

[76] Inventor: Joseph L. Guidry, 1572 Hampton Way, Santa Rosa, Calif. 95401

[22] Filed: Apr. 8, 1974

[21] Appl. No.: 459,113

[52] U.S. Cl. ..... 51/358; 51/170 T; 51/273; 51/356

[51] Int. Cl.[2] ..... B24D 13/18; B24B 23/02; B24D 9/08

[58] Field of Search ..... 51/356, 358, 376, 378, 51/394, 209 R, 170 T, 266, 270, 273; 15/230.1, 385

[56] References Cited

UNITED STATES PATENTS

| | | | |
|---|---|---|---|
| 2,599,952 | 6/1952 | Strayer | 51/266 |
| 2,636,324 | 4/1953 | Ruthven | 15/230.1 |
| 3,187,475 | 6/1965 | Sopcak | 51/378 X |
| 3,574,975 | 4/1971 | Liss | 51/356 |

FOREIGN PATENTS OR APPLICATIONS

| | | | |
|---|---|---|---|
| 132,081 | 6/1951 | Sweden | 51/270 |
| 907,862 | 10/1962 | United Kingdom | 51/378 |

*Primary Examiner*—Al Lawrence Smith
*Assistant Examiner*—Nicholas P. Godici
*Attorney, Agent, or Firm*—Gregg, Hendricson, Caplan & Becker

[57] ABSTRACT

A plastic disc of limited flexibility has radially offset vanes disposed about the upper surface thereof and extending part way thereacross for use as a backing disc for a rotary disc sander.

6 Claims, 4 Drawing Figures

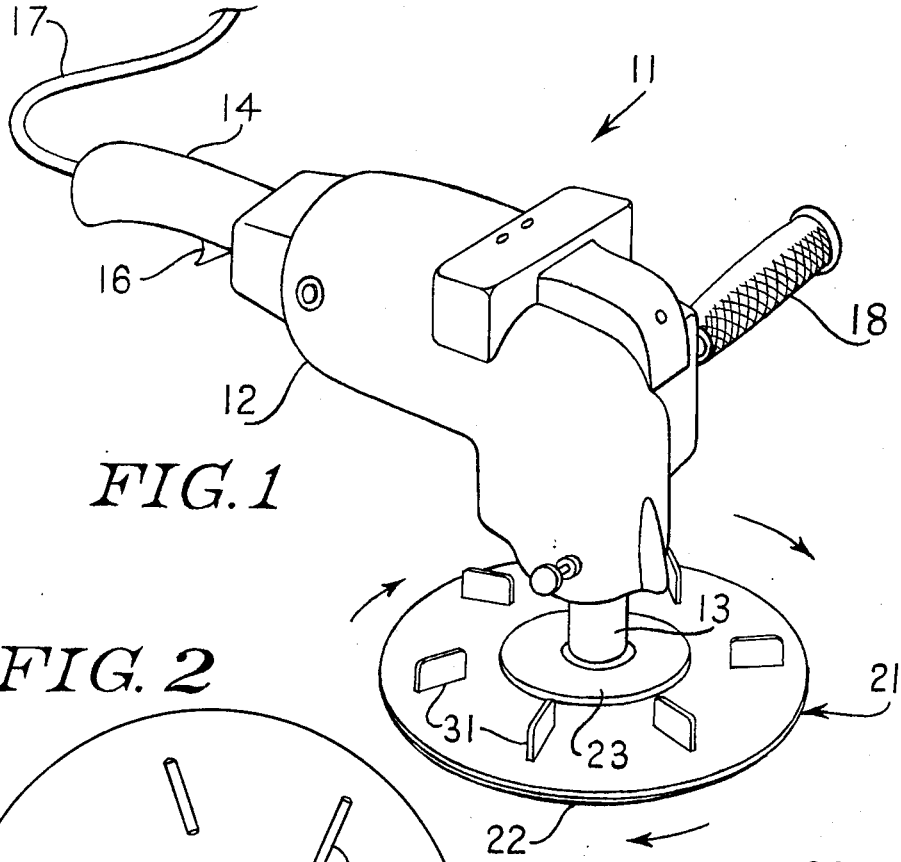
FIG. 1
FIG. 2
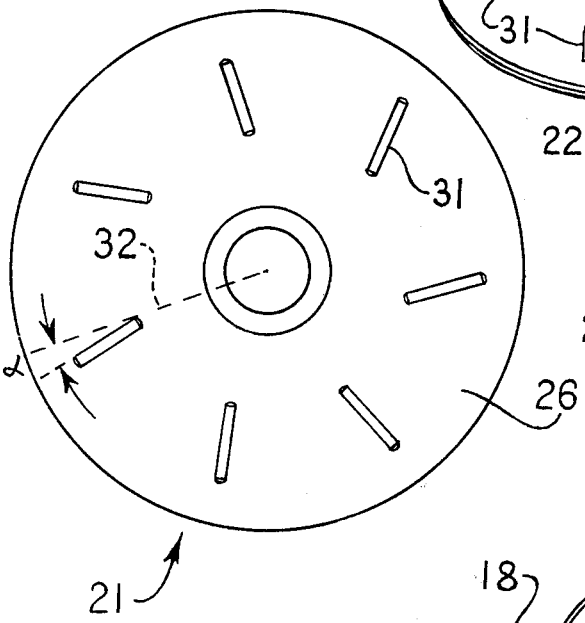
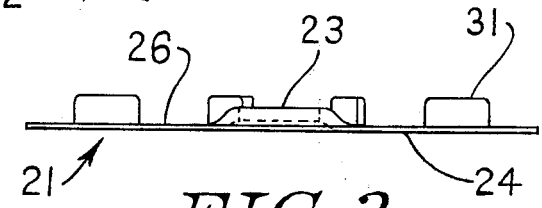
FIG. 3
FIG. 4
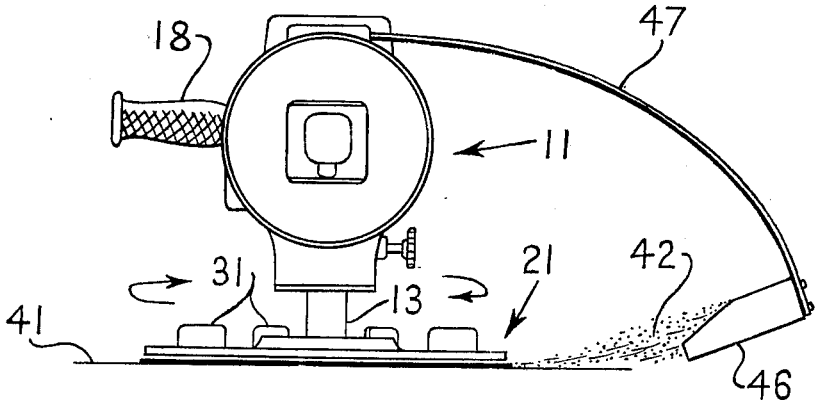

BACKING DISC WITH MEANS TO EXPEL ABRADED PARTICLES

BACKGROUND OF INVENTION

Portable disc sanders and the like include an electric motor in a housing with handles for holding same and a motor shaft extending from the housing for removable engagement with a sanding disc. The sanding disc itself may be formed as a cloth or paper element having an abrasive material on the front face thereof and normally a disc of this type is mounted upon a backing plate or backing disc and secured to the shaft end. A wide variety of different types of backing discs have been developed and employed. An early and favorite type of backing disc is formed of rubber and improvements thereon include thin metal discs and various types of plastic and Fiberglas discs.

The backing disc for a rotary disc sander provides the requisite rigidity to the abrasive sheet so that the latter may be forced against the workpiece as it is rotated and yet the backing disc should have at least limited flexibility. An early attempt at controlling the flexibility of a backing disc is shown in U.S. Pat. No. 1,778,470 wherein outwardly tapering ribs of varying configuration are employed in the back of the disc. Other improvements in backing discs have related to structures for automatic or self-cleaning of the abrasive surface, as illustrated, for example, in U.S. Pat. Nos. 3,110,140 and 3,187,475.

It is commonly accepted that portable power driven sanders and the like discharge sanded particles and dust rather indiscriminately into the atmosphere. It is recognized that this pollution of the atmosphere is harmful to operators and those in the vicinity as well as being undesirable from the viewpoint of depositing a film of dust upon surrounding surfaces. An operator may be at least partially protected by a mask; however, it is normally not feasible to cover all surrounding surfaces. Certain attempts have been made with stationary grinders, sanders and the like, to exhaust the particles ground or sanded from workpieces by the provision of separate or integral exhaust systems operating in the housing of the apparatus. Stationary equipment of this type is normally employed by manipulation of the workpiece so that exhaust systems are practicable; however, portable sanders or the like are operated by manipulation of the sander so that the operator must have a full view of at least the backing disc and thus housings thereabout for exhausting particles are not practical.

The present invention provides an improved backing disc for portable rotary sanders or the like providing for the ejection of particles, dust and the like, in a predetermined direction from the rotary equipment so that this material may be directed away from an operator and other surfaces in the area to be protected and may, in fact, be collected for disposal.

SUMMARY OF INVENTION

The present invention comprises a disc formed of limitedly flexible synthetic material, such as a plastic, with a central aperture therethrough for attachment to the end of the drive shaft of a rotary sander or the like. The outer or front face of the disc is adapted to have an abrasive sheet removably attached thereto. Upon the back of the disc there is disposed a plurality of blades of a rectangular configuration and extending generally radially of the disc thereabout but radially offset away from the direction of disc rotation in extension outwardly of the disc. These blades each extend only part way across the disc and are displaced both from the center of the disc and the outer periphery thereof. The plane of each of the blades lies in an acute angle to a radius of the disc and the blades point outwardly thereof away from the direction of rotation of the disc.

The blades disposed upon the back surface of the disc of the present invention produce a movement of air with disc rotation and, in fact, generate a relatively high velocity of air flow outwardly of the disc. Inasmuch as a rotary sander is normally operated only to engage a portion of the periphery thereof with the workpiece, it will be appreciated that particles removed by the sanding operation are generated at a single location. Consequently the air flow generated by the backing disc of the present invention expels these particles as a stream rather than allowing them to diffuse into the atmosphere in all directions. It has been found that, with a particular orientation of blades on the disc hereof, particles are expelled in a stream at substantially right angles to the portion of the disc engaging the workpiece. It is conventional to employ a portable rotary sander to engage the same portion of the disc circle with the workpiece and, under these circumstances, a dust and particle collector may actually be mounted upon the sander itself so that the stream of particles is directed therein for collection and ultimate disposal. This then overcomes prior art difficulties of air pollution, both as regards the operator of a rotary disc sander and the surrounding atmosphere and surfaces disposed in engagement therewith.

DESCRIPTION OF FIGURES

The present invention is illustrated as to a single preferred embodiment thereof in the accompanying drawings wherein:

FIG. 1 is a perspective illustration of a portable disc sander having a backing plate in accordance with the present invention attached thereto;

FIG. 2 is a plan view of the back surface of the backing disc of FIG. 1;

FIG. 3 is a side elevational view of the backing disc of FIG. 1; and

FIG. 4 is a schematic illustration of a portable sander carrying the backing disc of the present invention in operation and illustrating the removal of particles and the like in accordance herewith.

DESCRIPTION OF PREFERRED EMBODIMENT

In FIG. 1 there is illustrated a rotary disc sander carrying the backing disc of the present invention. The extender 11 will be seen to generally include a housing 12 within which there is disposed an electric drive motor (not shown) from which extends a drive shaft 13. The housing may include a handle 14 having a control switch 16 thereon with an electrical cord 17 extending therefrom for attachment to a convenience outlet. Commonly a rotary disc sander also incorporates a side handle 18 extending laterally from the housing perpendicularly to the handle 14. The backing disc 21 with an abrasive sheet 22 on the front face thereof is adapted to be mounted on the drive shaft 13 as by means of a screw (not shown) threaded into the end of the shaft with an enlarged head thereof fitting into a recess 23 in the backing plate.

The backing disc 21 of the present invention is formed of a limitedly flexible material, such as a suitable plastic, Fiberglas, or the like, with a substantially planar front face 24 upon which an abrasive sheet or disc of sandpaper or the like is adapted to be mounted. The back face 26 of the disc 21 is also of a planar configuration with the exception of the central raised portion of the recess 23 through which there extends an aperture for attaching the backing plate to the drive shaft. It is noted that the attachment of backing disc to drive shaft may be made in a variety of ways even including the system of U.S. Pat. No. 3,110,140, for example, inasmuch as such attachment forms no portion of the present invention.

Upon the back or rear surface 26 of the disc 21 there is disposed a plurality of blades 31. These blades 31 are generally rectangular in shape and extend perpendicularly from the rear surface 26 of the disc. It will be seen, particularly by reference to FIG. 2, that the blades 31 have a length of about one-third the radius of the disc, although it is possible to vary this dimension somewhat, and also that the outer ends of the blades are inset from the periphery of the disc as, for example, about one-fifth of the radius of the disc.

Considering further the blades 31, it will be noted in FIG. 2 that a plurality of blades is spaced equally about the circumference of the disc and it will also be noted that each of the blades is offset with regard to the radius of the disc. The disc sander of FIG. 1 is considered to drive the shaft 13 thereof in a clockwise direction, as indicated by the arrows in FIG. 1, and a similar arrow in FIG. 2 indicates this clockwise direction of rotation. Each of the blades is disposed with the outer end thereof in trailing relation to the other end in relation to the direction of rotation of the disc. Considering the radius 32 of the disc 21, it will be seen that the blade through which the radius extends is offset with respect to the radius by an acute angle $\alpha$ with the outer end of the blade in trailing relationship to the direction of rotation of the disc. Each of the blades is similarly oriented upon the disc. With regard to the height of the blades, it is possible for this dimension to be varied somewhat; however, a typical blade depth or height is about one-tenth to one-eighth of the disc radius. It will, of course, be appreciated that discs of different diameters may be formed in accordance with the present invention and thus blade dimensions are herein described in relation to disc radius. The angular offset of the individual blades may be varied somewhat; however, an angle of 10° to 15° has been found suitable.

Considering now the use of the present invention and operation thereof when attached to a disc sander or the like with an abrasive sheet affixed to the backing disc, it is noted that such a sander is conventionally employed for gripping the rear handle 14 with the right hand and the side handle 18 with the left hand. With the control 16 actuated to energize the drive motor, the shaft 13 is rotated in a clockwise direction and the operator moves the sander relative to the workpiece to engage the abrasive sheet with the workpiece at the front of the housing 12. Actual sanding is then accomplished with the sheet and the disc at approximately right angles of the disc to the side handle 18. It will, of course, be appreciated that certain variations in this mode of operation are possible; however, the foregoing is a brief statement of general operation. During sanding operations a substantial amount of particles, dust and the like, is sanded from the workpiece. The blades

31 of the backing disc hereof produce a forced flow of air generally outwardly of the disc. This has been found to produce a stream of air forcibly picking up and ejecting particles, dust and the like, at right angles of the disc from the contact of disc and workpiece. In a normal manner of operating the disc sander, as briefly stated above, the dust and particles are thus forcibly ejected directly away from the side handle 18. This is generally illustrated in FIG. 4 wherein the disc sander 11 is schematically illustrated as engaging a workpiece 41 in the manner generally described above. This engagement will produce a plurality of particles, dust and the like, ground from the workpiece which are directed by the backing plate of the present invention in a stream 42 that is relatively concentrated and which is directed outwardly of the disc directly away from the side handle 18 of the sander. This concentration of exhaust material is highly advantageous in that the workpiece may, for example, be so oriented that the exhausted particles, dust and the like, will travel only into a reception area and it is even possible to intercept this stream of particles by means associated with the sander itself.

In FIG. 4 there is schematically illustrated a catcher or receptacle 46 which may, for example, be mounted by an arm 47 on the sander housing 12. The exact placement and configuration of the receptacle 47 may be varied and same is only schematically illustrated herein to emphasize the limitation upon the material exhausted from the sanding operations employing the backing disc of the present invention. These exhausted materials are, in fact, confined to a relatively thin stream expelled from the disc about 90° displaced from the point of contact of the disc with the workpiece. It will also be appreciated that the mounting arm 47 may be expanded immediately above the receptacle 46 in order to intercept the flow of particles 42 so the same will fall into the receptacle somewhat as illustrated in FIG. 4. It is not intended herein, however, to indicate that it is necessary to provide a receptacle for intercepting materials directed away from the sanding operation in a thin stream by the present invention. Material advantage lies in the capability of the present invention to limit the direction of material expelled from the portable sanding operation inasmuch as prior art portable sanders provide no such capability.

Although the present invention has been described above with respect to a single preferred embodiment thereof, it is not intended to limit the invention to the details of illustration nor terms of description, for it will be apparent to those skilled in the art that modifications and variations are possible within the scope of the present invention.

What is claimed is:

1. In a backing disc that is to be rotated in a predetermined direction and has an abrasive material engaging a front face thereof, a plurality of blades disposed on the rear surface of said disc about the circumference thereof and spaced inwardly of the disc periphery and spaced from the center of the disc, said blades each having a substantially rectangular flat planar configuration with the plane thereof being substantially normal to the disc and each of said blades being disposed in angular offset relation to a radius of the disc in trailing relation to the direction of rotation of the disc.

2. In a backing disc as defined in claim 1 each of said blades having a length substantially radially of said disc substantially one-third of the radius of said disc.

3. In a backing disc as defined in claim 1 each of said blades having a height normal to said disc that is substantially one-tenth of the radius of said disc.

4. In a backing disc as defined in claim 1 each of said blades being spaced generally radially inwardly of the disc periphery substantially one-quarter of the radius of the disc and spaced from the center of the disc substantially one-half of the radius of the disc.

5. A backing disc for a portable power sander or the like comprising a flat circular disc having limited flexibility and a central aperture for attachment to a driven shaft and attachment of an abrasive sheet to a front face thereof, and a plurality of substantially rectangular planar blades extending substantially perpendicularly from the back face of said disc, said blades being spaced radially inward of the disc periphery and spaced from the center of the disc, and said blades being disposed about said face in an angled relation to a radius of the disc in a direction away from the direction of rotation of the disc outwardly of the blades for creating a draft of air to direct particles and the like in a predetermined direction away from the disc during sanding operations.

6. An attachment for a portable power tool for abrading or cutting a workpiece and having a rotary shaft extending therefrom, comprising a flat disc having a central aperture for mounting the disc on an end of said shaft and having a plurality of substantially rectangular planar blades extending perpendicularly from a first face of said disc, said blades being spaced radially inward of the disc periphery and spaced from the center of the disc, and said blades each being disposed with the outer blade end in like angular offset relation to separate radii of said disc about the disc and in trailing relation thereto in relation to the direction of rotation of said disc by said shaft for directing particles abraded or cut from a workpiece by said tool in a single direction away from the workpiece.

* * * * *